United States Patent [19]

Dextrase

[11] Patent Number: 4,996,724

[45] Date of Patent: Mar. 5, 1991

[54] PROTECTIVE RIM CONFIGURATION FOR HARD-SHELLED SAFETY HELMET

[75] Inventor: Serge Dextrase, Granby, Canada

[73] Assignee: Innova-Dex Sports, Inc., Canada

[21] Appl. No.: 424,816

[22] Filed: Oct. 20, 1989

[51] Int. Cl.[5] ..... A42B 3/02

[52] U.S. Cl. ..... 2/411; 2/425

[58] Field of Search ..... 2/425, 411, 412, 414, 2/423, 424, 410, 6

[56] References Cited

U.S. PATENT DOCUMENTS 4,101,983 7/1978 Dera et al. ..... 2/425 X 4,656,667 4/1987 Blake ..... 2/412 X

FOREIGN PATENT DOCUMENTS 0048442 3/1982 European Pat. Off. .

0183971 6/1986 European Pat. Off. .

3025770 2/1982 Fed. Rep. of Germany ..... 2/425

8001561 7/1981 France .

*Primary Examiner*—Peter Nerbun

*Attorney, Agent, or Firm*—Larson and Taylor

[57] ABSTRACT

A hard shelled safety helmet comprises a protective rim configuration for the helmet and a shock absorbent liner therefor. The rim extends within a groove formed in the liner.

14 Claims, 2 Drawing Sheets

PROTECTIVE RIM CONFIGURATION FOR HARD-SHELLED SAFETY HELMET

FIELD OF THE INVENTION

The present invention relates generally to the field of safety helmets and more specifically, to a novel rim configuration for use with a hard-shelled safety helmet and which is protective of the shock absorbent liner therefor.

BACKGROUND OF THE INVENTION

Heretofore, it has been known in the art to provide safety helmets comprising an impact resistant outer shell and an inner shock-absorbent liner therefor which is contoured to fit and protect the cranium and nape of the wearer. These hard-shelled helmets are to be distinguished from what is referred to in the art as the "soft-shelled" variety, wherein no rigid outer shell is provided to encase the liner element. In such "soft-shelled" helmets, the liner element is either left entirely exposed or is covered, for largely aesthetic reasons, with a fabric mesh or with some other generally elastic thin membrane or fabric.

The outer shell for hard-shelled safety helmets may normally be integrally moulded from a thermoformable plastic material, for instance, polystyrene or the like. Similarly, the inner liner for these safety helmets may also be integrally formed, from such materials as expanded polystyrene foam, for example. Generally, the liner element is shaped for intimate slip-fit engagement with the outer shell element, and may be held therein by way of adhesives or other suitable means. It is also customary to provide for retention straps which secure the helmet to the head of the wearer by means of a chin strap configuration or the like. Such straps may be constructed, for instance, from nylon webs and may be provided with quick-release release buckling means as well as with length adjustment means to ensure proper fit.

The prior art hard-shelled safety helmets may be employed for numerous purposes where head injuries are normally prevalent or are of particularly dangerous consequence. Thus, hard-shelled helmets of the type described above may be adapted for use in a diversity of applications, such as in numerous sporting activities, or in the field of road transportation or that of construction. Typically, such hard-shelled helmets have been found especially suitable in the fields of bicycling and motorcycling.

The prior art helmets discussed above are associated with a number of problems and inconveniences. For instance, the known helmet configurations may result in hard edges being exposed around the lower periphery of the relatively thin outer shell, and adjacent the face, forehead or neck of the wearer, thereby presenting the increased risk of injury to the wearer in the event of an accidental collision or upon some other impacting force being brought to bear on the helmet surface.

Another problem associated with some of the prior art helmets is that the shock-absorbent liners therefor are left uncovered at the lower portions thereof, immediately adjacent the lower periphery of the outer shell. This type of construction is disadvantageous for the reason that the liner material, normally a low density soft material such as expanded polystyrene foam, is more readily damaged and soiled when the helmet is removed by the wearer and carried by such person or placed on a hard surface with the rim thereagainst. It has been found that with normal use, the liner material of some of the prior art helmet configurations is subject to marked deterioration in the region of the helmet rim, thereby reducing the impact absorbing effectiveness of the helmet.

It is yet another disadvantage of some of the known helmet configurations that the exposed shell edges or uncovered liner portions associated therewith may be aesthetically displeasing, for instance to image-conscious atheletes or enthusiasts such as in the field of bicycling.

For the reasons outlined hereinabove, it is one object of the present invention to provide a novel rim configuration for use with hard-shelled safety helmets which eliminates hard exposed edges around the lower periphery of the outer shells of such helmets.

It is a further object of the present invention to provide a rim configuration for hard-shelled helmets which is protective of the shock absorbent liner at the lower periphery of the outer shell, thereby overcoming the problems occasioned by the prior art constructions discussed above.

It is another object of the present invention to provide a novel rim configuration which has the advantageous features discussed above and which further provides an aesthetically pleasing helmet construction.

It is yet another object of the present invention to provide a novel rim configuration for hard-shelled helmets which is of relatively simple construction.

SUMMARY OF THE INVENTION

The present invention provides a protective rim configuration for a hard-shelled safety helmet and the shock-abosorbent inner liner therefor which overcomes the problems and inconveniences associated with the prior art safety helmets discussed hereinabove.

According to one broad aspect of the present invention, there is provided a hard-shelled safety helmet comprising: a shock-absorbent inner liner, said liner being shaped to fit the cranium of a wearer; impact resistant outer casing for said liner, said casing comprising mating top dome and bottom rim portions, an inner surface of said top dome portion being adapted for intimate engagement with an outer surface of said inner liner, said liner extending below said top dome portion when received therein to thereby provide an exposed portion of said outer surface; said bottom rim portion providing, adjacent a lower periphery thereof, an inwardly extending web and a flange projecting upwardly from said web, an inner surface of said bottom rim portion of said casing being adapted for intimate engagement with said exposed portion of said outer surface of said liner and providing a protective cover therefor; said flange of said bottom rim portion being engaged by corresponding receiving means disposed adjacent a lower periphery of said liner, said receiving means constituting means for engaging said flange of said bottom rim portion so as to prevent said flange from contacting the cranium of the wearer.

According to a second broad aspect of the present invention, there is provided a hard-shelled safety helmet comprising: an impact resistant outer casing and a shock-absorbent inner liner for said casing; wherein said outer casing provides, adjacent a lower peripheral edge thereof, an inwardly and upwardly extending lip means for engagement with a corresponding receiving means therefor disposed adjacent a lower peripheral edge of said liner to thereby provide a smooth-surfaced protective rim therefor, said receiving means constituting means for engaging said lip means of said outer casing so as to prevent said lip means from contacting the cranium of the wearer.

According to a third broad aspect of the present invention there is provided a hard-shelled safety helmet comprising: a shock-absorbent inner liner, said liner being shaped to fit the cranium of a wearer; an impact resistant outer casing for said liner, said casing comprising mating top dome and bottom rim portions, an inner surface of said top dome portion being adapted for intimate engagement with an outer surface of said inner liner, said liner extending below said top dome portion when received therein to thereby provide an exposed portion of said outer surface, said bottom rim portion providing, adjacent a lower periphery thereof, an inwardly extending web and a flange projecting upwardly from said web, an inner surface of said bottom rim portion of said casing being adapted intimate engagement with said exposed portion of said outer surface of said liner and providing a protective cover therefor, said flange of said bottom rim portion being engaged by corresponding groove means disposed adjacent a lower periphery of said liner.

BRIEF DESCRIPTION OF THE DRAWINGS

For purposes of illustration, but not of limitation, preferred embodiments of the present invention are described hereinbelow with reference to the following drawings in which.

DETAILED DESCRIPTION OF PREFERRED EMBODIMENTS

Figure 1:
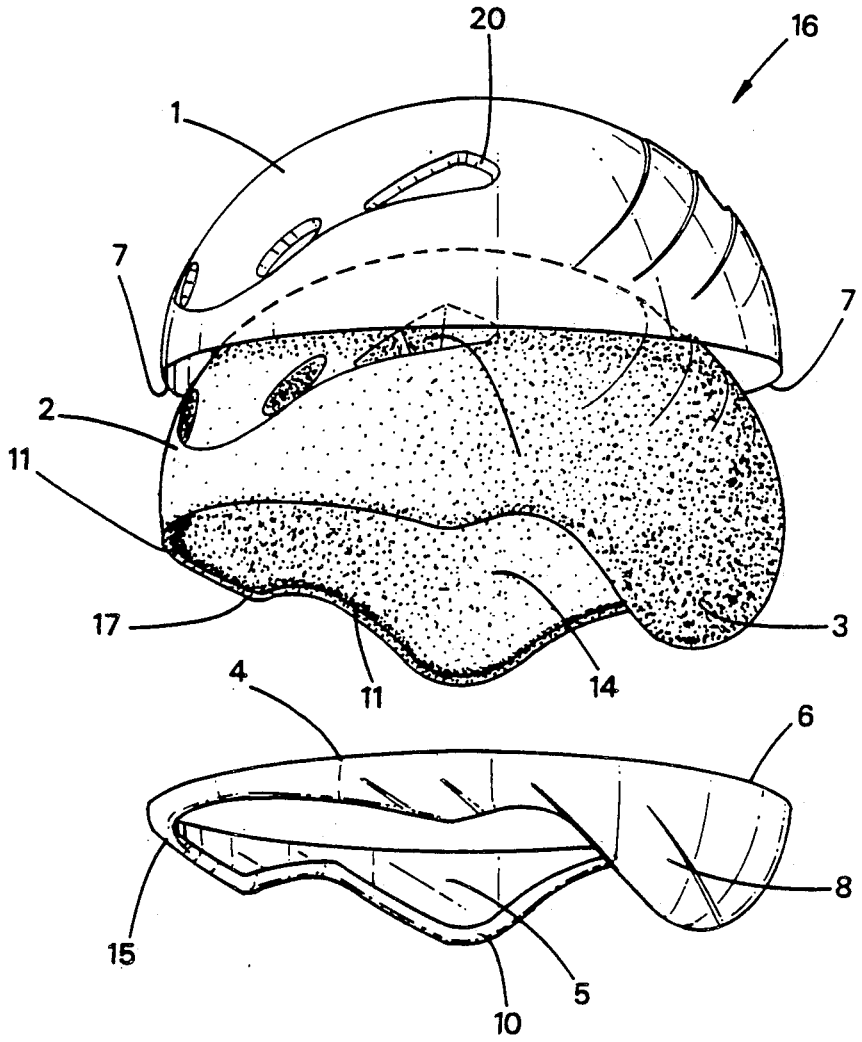
FIG. 1 is an exploded perspective view of a hard-shelled safety helmet and inner liner therefor which embody the protective rim configuration according to the present invention.

Referring now to the drawings, there is shown in FIGS. 1 to 5, a preferred embodiment of the protective rim configuration according to the present invention. As shown in FIG. 1, a safety helmet 16 employing the present invention provides an integrally moulded thin-shelled outer casing comprising a top dome portion 1 and a bottom rim portion 4. Top dome portion 1 and bottom rim portion 4 of the outer casing are preferably constructed from an impact resistant thermoformable material, such as high density polystyrene. However, those skilled in this art will readily appreciate that numerous materials may be adapted for use with the present invention, for instance, other impact resistant materials such as polycarbonates or laminated fiberglass.

Top dome portion 1 has a generally semiellipsoidal configuration and is adapted to receive, in intimate engagement, a shock-absorbent inner liner 2, which liner is suitably contoured to fit the cranium and nape of the wearer. The inner surface of the dome portion 1 is adapted for intimate engagement with the outer surface of liner 2. Preferably, the liner for use with the present invention will be of integrally moulded construction and formed from a thermoformable material such as expanded polystyrene foam. However, other suitable constructions and materials will be evident to those skilled in the art.

Figure 2:
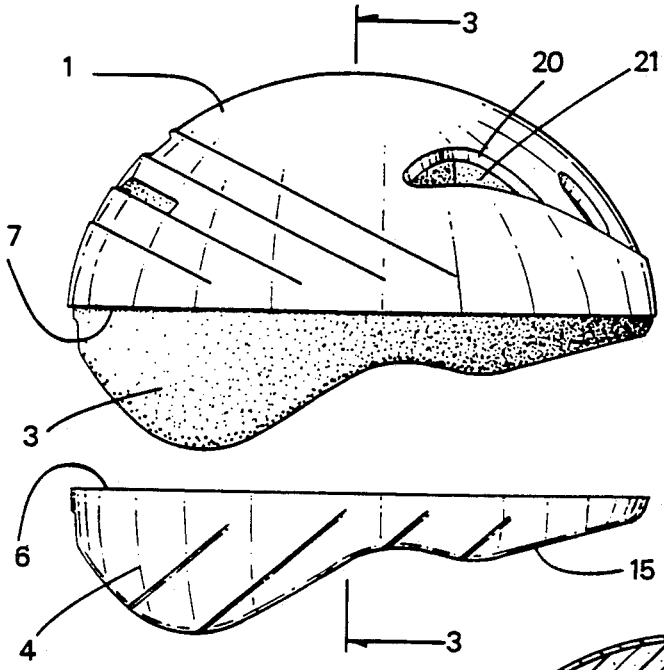
FIG. 2 is a partially exploded side elevational view of the helmet depicted in FIG. 1.

When received therein, liner 2 extends below top dome portion 1 to thereby provide an exposed peripheral surface 3, as shown more fully in FIG. 2. Rim portion 4 is provided for covering this exposed lower portion 3 of the outer surface of liner 2. The inner surface 5 of bottom rim portion 4 and the surface of lower exposed portion 3 of liner 2 are adapted for intimate engagement. Top dome portion 1 and bottom rim portion 4 of the outer casing may be affixed to the inner liner 2 by means of contact cement or any other suitable means well known to those skilled in this art.

Bottom rim portion 4 provides an upper peripheral edge 6 which is contoured to meet in substantial alignment with the lower peripheral edge 7 of top dome portion 1 when rim 4 is received over the exposed lower surface 3 of liner 2. For aesthetic purposes, a thin opaque band of adhesive tape (not shown) or the like may be employed to cover the adjacent respective edges 6, 7 of the assembled top dome portion 1 and bottom rim portion 4 around the periphery of the helmet. Adjacent its lower periphery 15, bottom rim portion 4 further provides an inwardly and upwardly extending lip means shown more particularly in FIG. 4. The lip configuration comprises a web portion 9, which extends inwardly from the lateral casig 8 of bottom rim portion 4, and a short flange portion 10, which extends upwardly from said web portion. Thus, bottom rim portion 4 has an asymmetrical generally U-shaped configuration at the lower periphery thereof.

Figure 4:
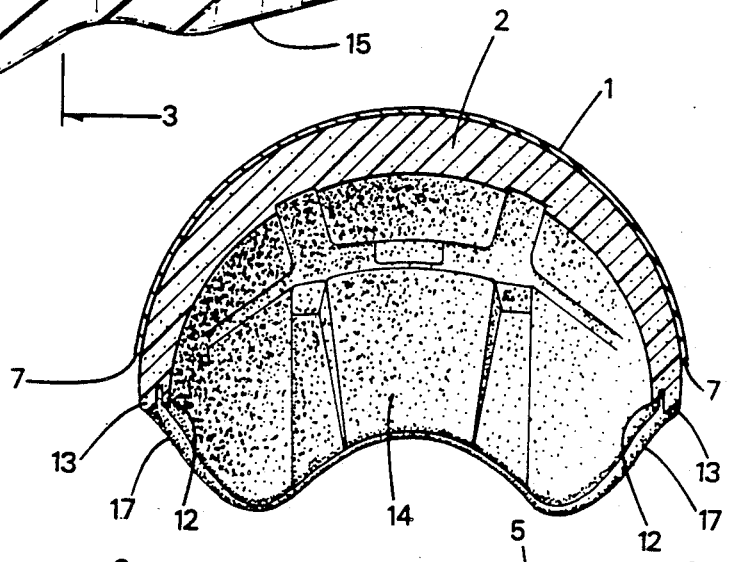
FIG. 4 is a detailed cross-sectional view of the lower periphery of the helmet depicted in FIG. 3, with the assembled configuration of its rim portion being shown in broken lines.
Figure 3:
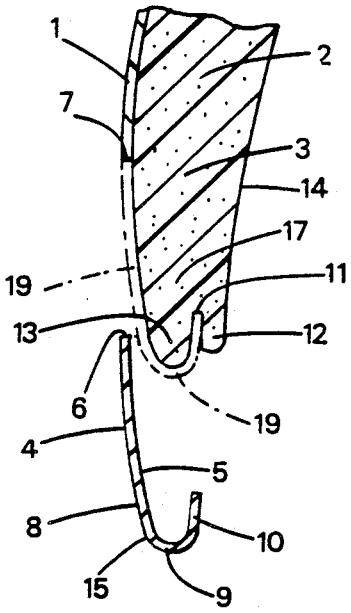
FIG. 3 is a front cross-sectional view of the helmet shown in FIG. 2 and taken along the line 3—3 thereof.
Figure 3:
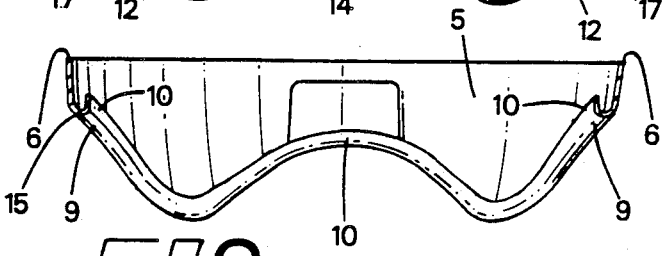

The edge or lower periphery 17 of the lower exposed portion 3 of liner 2 is correspondingly shaped for receiving the aforesaid lip configuration of bottom rim portion 4. For instance, lower portion 3 of liner 2 may be provided with a continuous groove 11 adjacent the edge 17 and extending around the periphery thereof, which groove is adapted to engage with the upwardly extending flange portion 10 of bottom rim portion 4. As shown in FIG. 4, the peripheral surface of the edge 17 of lower portion 3 of liner 2 is preferably contoured in such manner that the inner portion 12 of the edge 17 adjacent groove 11 is shorter than the outer portion 13 thereof. As a result, the exposed inner surfaces 14 of liner 2 do not extend past the adjacent peripheral surface 15 of bottom rim portion 4 in the assembled helmet, the assembled configuration of bottom rim portion 4 being denoted by broken lines 19 in FIG. 4.

Such a construction as described above advantageously protects the shock-absorbent liner 2 from dirt and excessive wear when the helmet is removed from the head of its wearer and placed on the ground or some other surface with the rim portion thereagainst. In addition, the protective rim configuration according to the present invention presents no sharp or abrupt edges to the facial regions of the wearer, thereby improving the safety features of a helmet embodying the invention. Morever, the present rim configuration provides the foregoing advantages while retaining an aesthetically pleasing design when compared to known constructions for hard-shelled helmets wherein the lower periphery of the liners therefor are left largely exposed.

Figure 5:
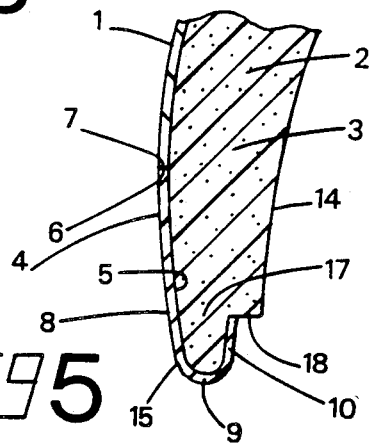
FIG. 5 is a detailed cross-sectional view of the lower periphery of an assembled safety helmet according to a second embodiment of the protective rim configuration of the present invention.

In another embodiment of the invention, shown in FIG. 5, the leading edge 17 of lower portion 3 of liner 2 is provided with a continuous stepped surface 18 extending around the periphery thereof. As in the previously described embodiment, the stepped surface 18 receives the upwardly extending flange portion 10 of bottom rim portion 4. Those skilled in the art will readily understand that such a stepped surface may be wider than the thickness of the flange portion 10 as shown, or may instead be of a width such that the flange portion 10 lies flush with the inner surface 14 of liner 2.

It will be appreciated by those skilled in this art that retention straps (not shown) for securing the helmet to the head of its wearer may be affixed to the top dome portion 1 thereof. Liner 2 may then be provided with suitable apertures (not shown) for said retention straps to pass therethrough. Likewise, for certain uses to which the safety helmet may be put, for instance bicycling, it may be advantageous to provide for a plurality of corresponding ventilation holes 20, 21 through the respective surfaces of top dome portion 1 and inner liner 2.

It is of course to be understood that the present invention has been described above purely by way of example, and those skilled in this art will appreciate that various other modifications of detail can be made coming within the scope of the invention as defined in the following appended claims.

What I claim as my invention is:

1. A hard-shelled safety helmet comprising: a shock-absorbent inner liner, said liner being shaped to fit the cranium of a wearer; an impact resistant outer casing for said liner, said casing comprising mating top dome and bottom rim portions, an inner surface of said top dome portion being adapted for intimate engagement with an outer surface of said inner liner, said liner extending below said top dome portion when received therein to thereby provide an exposed portion of said outer surface; said bottom rim portion providing, adjacent a lower periphery thereof, an inwardly extending web and a flange projecting upwardly from said web, an inner surface of said bottom rim portion of said casing being adapted for intimate engagement with said exposed portion of said outer surface of said liner and providing a protective cover therefor; said flange of said bottom rim portion being engaged by corresponding receiving means disposed adjacent a lower periphery of said liner, said receiving means constituting means for engaging said flange of said bottom rim portion so as to prevent said flange from contacting the cranium of the wearer.

2. The safety helmet according to claim 1, wherein said top dome and bottom rim portions are each integrally formed.

3. The safety helmet according to claim 1, wherein said corresponding receiving means is a groove.

4. The safety helmet according to claim 1, wherein said corresponding receiving means is a stepped surface.

5. The safety helmet according to claim 3, wherein said liner extending below said top dome portion forms a continuous exposed surface adjacent the lower periphery of said dome portion, and wherein said bottom rim portion is correspondingly of a continuously encircling configuration.

6. The safety helmet according to claim 5, wherein said groove is continuously disposed adjacent the lower periphery of said liner.

7. The safety helmet according to claim 6, wherein said bottom rim portion, adjacent the lower periphery thereof, has an asymmetrical generally U-shaped configuration.

8. The safery helmet according to claim 7, wherein said U-shaped configuration of said rim portion is continuously disposed therearound.

9. The safety helmet according to claim 8, wherein an outer portion of said lower periphery adjacent said groove, extends below an inner portion thereof.

10. The safety helmet according to claim 9, wherein said outer casing is composed of a thermoformable material.

11. The safety helmet according to claim 10, wherein said casing is composed of high density polystrene.

12. The safety helmet according to claim 11, wherein said inner liner is integrally formed and is composed of expanded polystyrene foam.

13. A hard-shelled safety helmet comprising: an impact resistant outer casing and a shock-absorbent inner liner for said casing; wherein said outer casing provides, adjacent a lower peripheral edge thereof, an inwardly and upwardly extending lip means for engagement with a corresponding receiving means therefor disposed adjacent a lower peripheral edge of said liner to thereby provide a smooth-surfaced protective rim therefor, said receiving means constituting means for engaging said lip means of said outer casing so as to prevent said lip means from contacting the cranium of the wearer.

14. A hard-shelled safety helmet comprising: a shock-absorbent inner liner, said liner being shaped to fit the cranium of a wearer; an impact resistant outer casing for said liner, said casing comprising mating top dome and bottom rim portions, an inner surface of said top dome portion being adapted for intimate engagement with an outer surface of said inner liner, said liner extending below said top dome portion when received therein to thereby provide an exposed portion of said outer surface, said bottom rim portion providing, adjacent a lower periphery thereof, an inwardly extending web and a flange projecting upwardly from said web, an inner surface of said bottom rim portion of said casing being adapted for intimate engagement with said exposed portion of said outer surface of said liner and providing a protective cover therefor, said flange of said bottom rim portion being engaged by corresponding groove means disposed adjacent a lower periphery of said liner.

* * * * *